US005476340A

United States Patent [19]

Contrasto

[11] Patent Number: 5,476,340

[45] Date of Patent: Dec. 19, 1995

[54] METHOD OF USING INTERNAL METAL STITCHING FOR REPAIRING CRACKS IN CONCRETE

[76] Inventor: Sam Contrasto, 307 Palm Ave., Nakomis, Fla. 34275

[21] Appl. No.: 361,183

[22] Filed: Dec. 21, 1994

[51] Int. Cl.[6] ..... E01C 7/06

[52] U.S. Cl. ..... 404/75; 404/70; 52/514.5; 264/35

[58] Field of Search ..... 404/47, 49, 68–70, 404/75, 87–89, 100, 101, 107; 52/514, 514.5, 742.1, 742.13, 742.14, 742.16, 741.41; 264/36

[56] References Cited

U.S. PATENT DOCUMENTS 4,507,013 3/1985 Martinak ..... 404/75

*Primary Examiner*—Ramon S. Britts
*Assistant Examiner*—Pamela A. O'Connor
*Attorney, Agent, or Firm*—Frank A. Lukasik

[57] ABSTRACT

An internal metal stitching method for repairing cracks in concrete comprising the steps of cutting slots to facilitate large metal brackets installed every two feet and at alternating angles to the crack. Saw cuts are made in the concrete and near the ends of each large bracket to accommodate end brackets which when fitted resemble a double "t". The saw cuts are cleaned and dryed, filled with a filler resin, and the metal brackets are reinserted and are submerged ¼ below the concrete surface. The filler is smoothed out to a level flush with the concrete surface. Additional decorative surfaces may then be applied, such as ceramic tiles, carpeting, linoleum or paint.

3 Claims, 16 Drawing Sheets

METHOD OF USING INTERNAL METAL STITCHING FOR REPAIRING CRACKS IN CONCRETE

BACKGROUND OF THE INVENTION

1. Field of the Invention

This invention relates generally to concrete crack repair and more specifically to concrete internal metal stitching and a cost effective method for restoring the tensile strength to a cracked concrete section.

2. Description of the Prior Art

Concrete stitching is a simple, cost effective technique for restoring the tensile strength to a cracked concrete section. It also can increase the shear capacity of flexural members. Most repair contractors already have the necessary equipment and tools to stitch cracks.

The most common stitching methods use either stitching dogs (U-shaped metal units) thin metal interlocking plates, or dowel bars for reinforcement. In each method, the reinforcement is installed across the crack and is bonded to each side of the crack with epoxy or cementitious materials. The amount of reinforcement can be varied to achieve the desired strength restoration. Unlike interlocking plates and dowel bars, which are embedded in the concrete, stitching dogs are surface mounted. Concrete in axial tension, therefore, stitching dogs on both faces. Stitching dogs are most effective when restoring tension in bending members since they are placed at the critical location-the tension face.

To install stitching dogs, holes are drilled on both sides of the crack, the holes are cleaned, and the legs of the dog are anchored in the holes with nonshrink grout or epoxy. The length, orientation, and location of the stitching dogs are varied so that the tension is transmitted across the area, not across a single plane within the section.

Because dogs are thin and long and aren't supported laterally, they cannot take much compressive force. If the crack closes as well as opens, the dogs must be stiffened and strengthened to prevent buckling. One method to prevent buckling is to embed the dogs in an overlay.

Dowel bars are also used to repair concrete cracks. To install dowel bars, two holes are drilled diagonally through the crack, one from each side. The holes are filled with nonshrink cementitious or epoxy materials, then a dowel bar is driven into each hole. The bonded dowel bars transmit force across the crack face. The angled dowel bars restore shear transfer and transmit axial tension, but aren't very effective for restoring tension in flexural members.

Because dogs are thin and long, and aren't supported laterally, they cannot take much compressive force. If the crack closes as well as opens, the dogs must be stiffened and strengthened to prevent buckling. The angled dowel bars restore shear transfer and transfer axial tension, but aren't very effective for restoring tension in flexural members.

SUMMARY OF THE INVENTION

The invention is a process and a system for repairing concrete cracks. A concrete saw is used to cut slots to facilitate large metal brackets installed every 2 feet and at alternating angles to the crack. Small end brackets are fitted that resemble a double "t". The end brackets lock and stabilize the large brackets. The slots are then cleaned and dryed, filled with a resin filler mix and the metal brackets are submerged ¼ below the concrete surface where they solidify within the filler. If possible, a new control cut is made to relieve stresses from the repair area. The excess filler is ground flush when dry or scraped off when liquid (soft) and the surface can be coated with a variety of materials such as polymer modified cement acrylic stain and clear sealers.

DESCRIPTION OF THE PREFERRED EMBODIMENT

Figure 1:
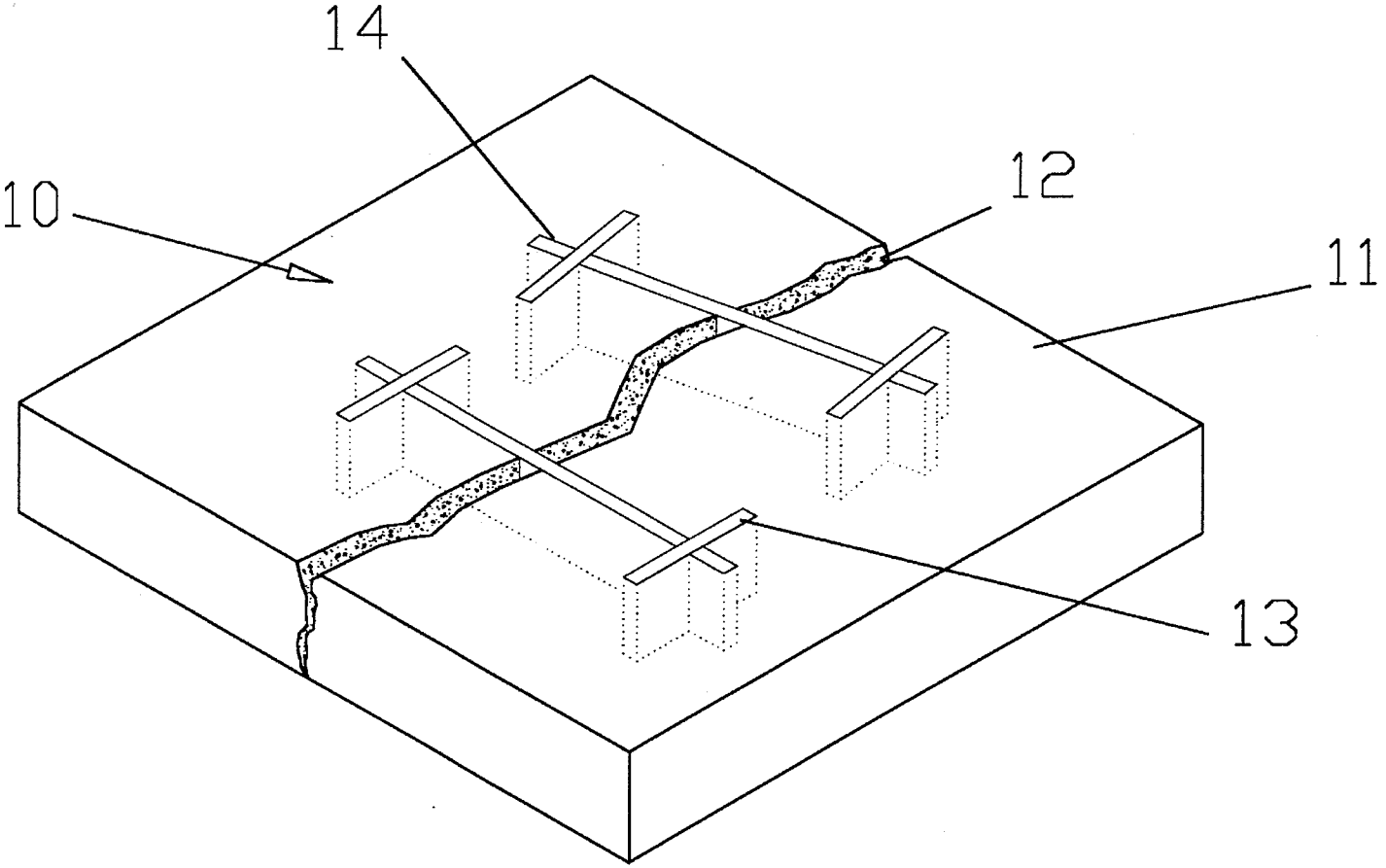
FIG. 1 is a top perspective view of the double "t" assembly of the metal brackets of the invention.
Figure 2:
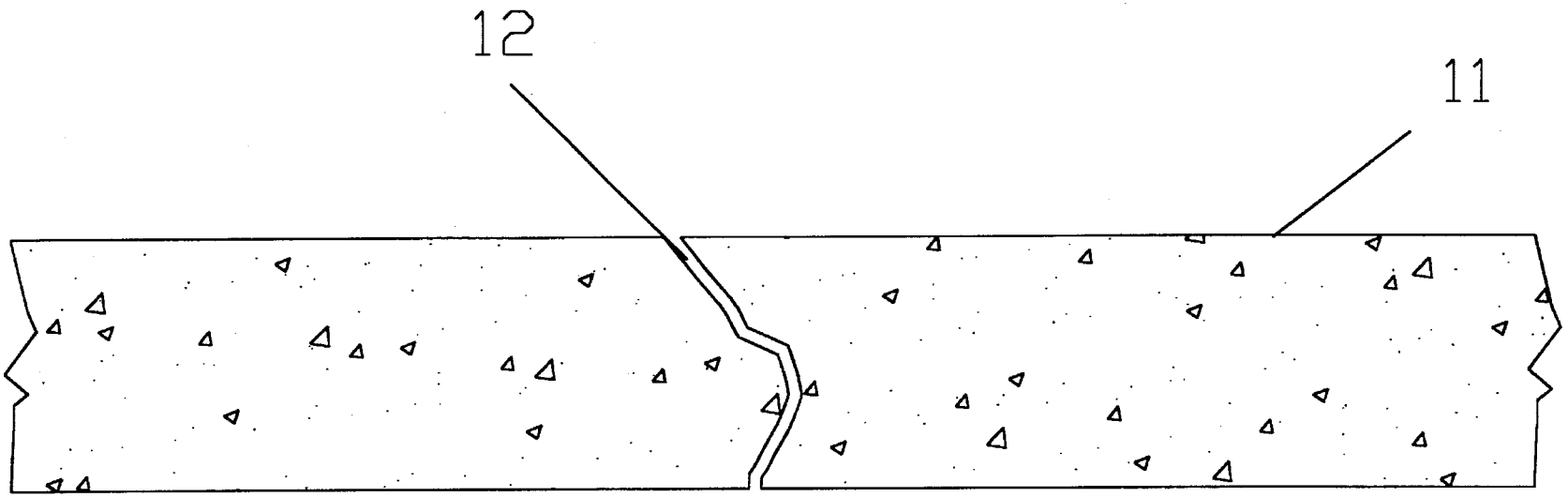
FIG. 2 is a cross section of a section of concrete showing a crack.
Figure 3:
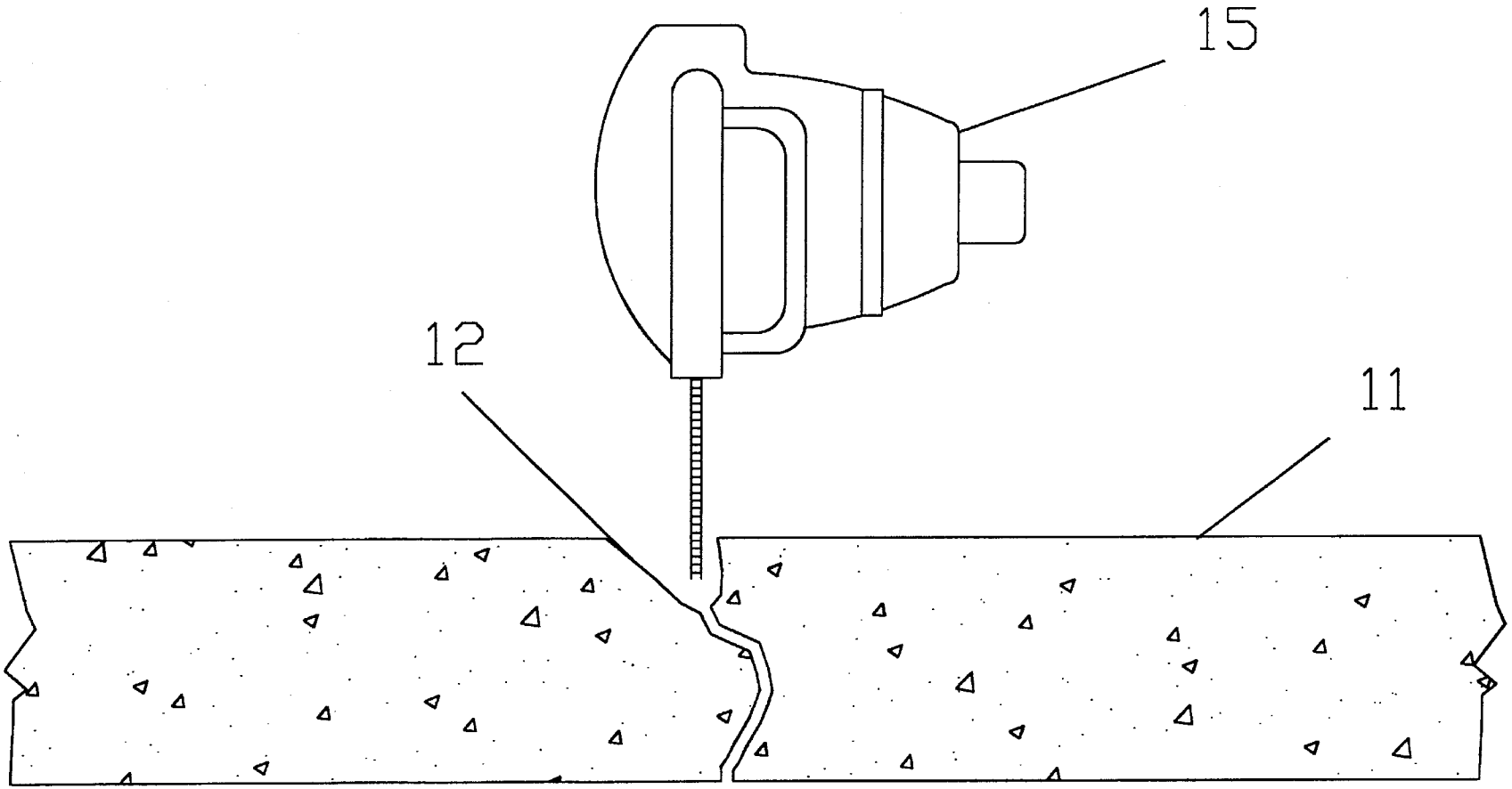
FIG. 3 is a side view of a concrete saw cleaning out a concrete crack.
Figure 4:
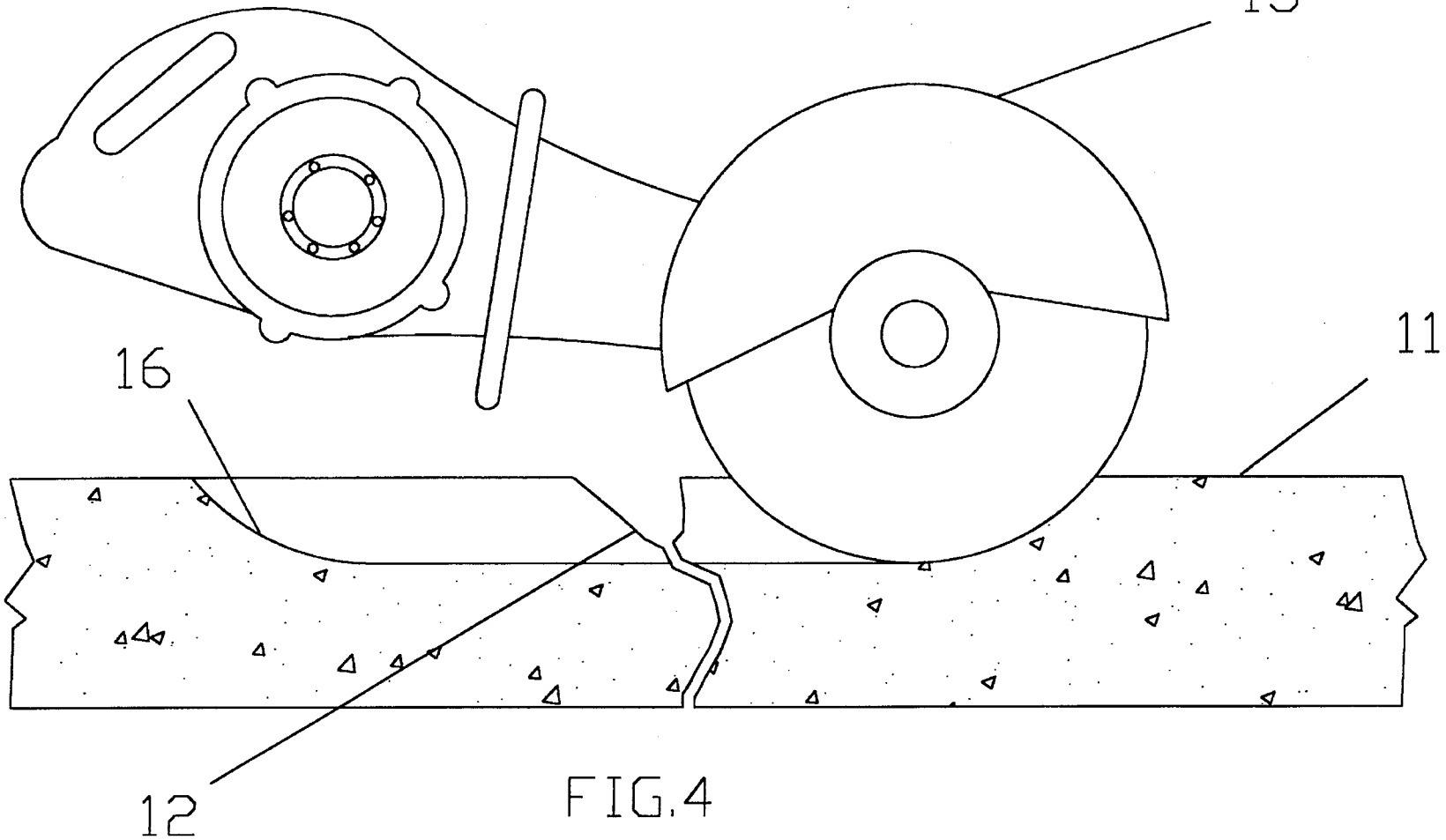
FIG. 4 is a side view of a hand saw making a cut in a concrete slab, partially in section.
Figure 5:
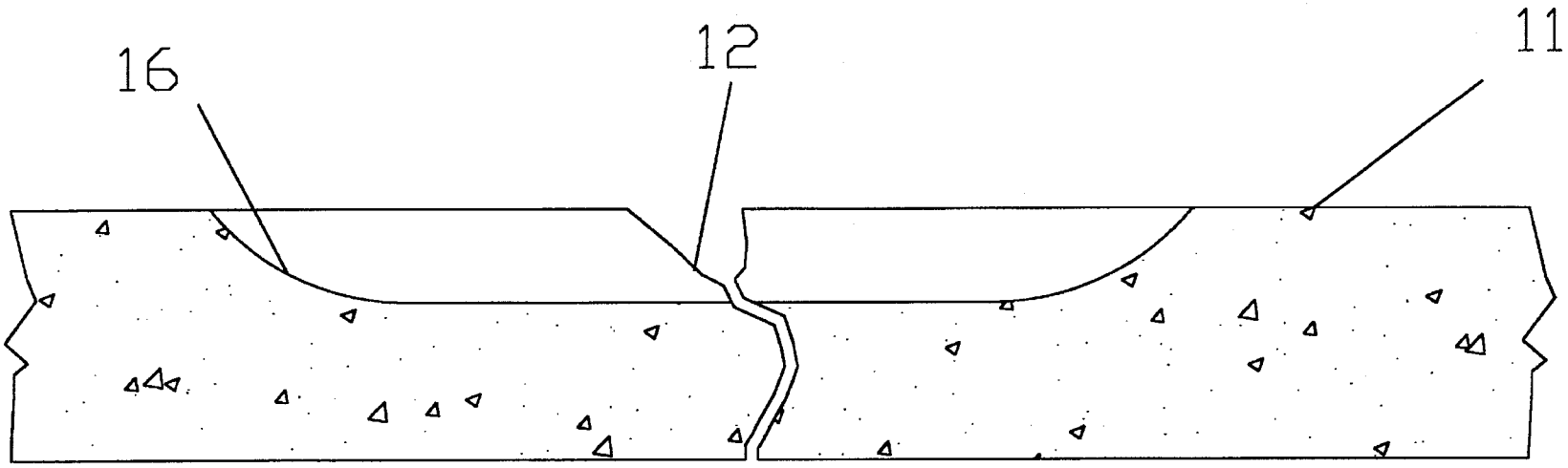
FIG. 5 is a side view, partially in section, of a finished saw cut in a concrete section.
Figure 6:
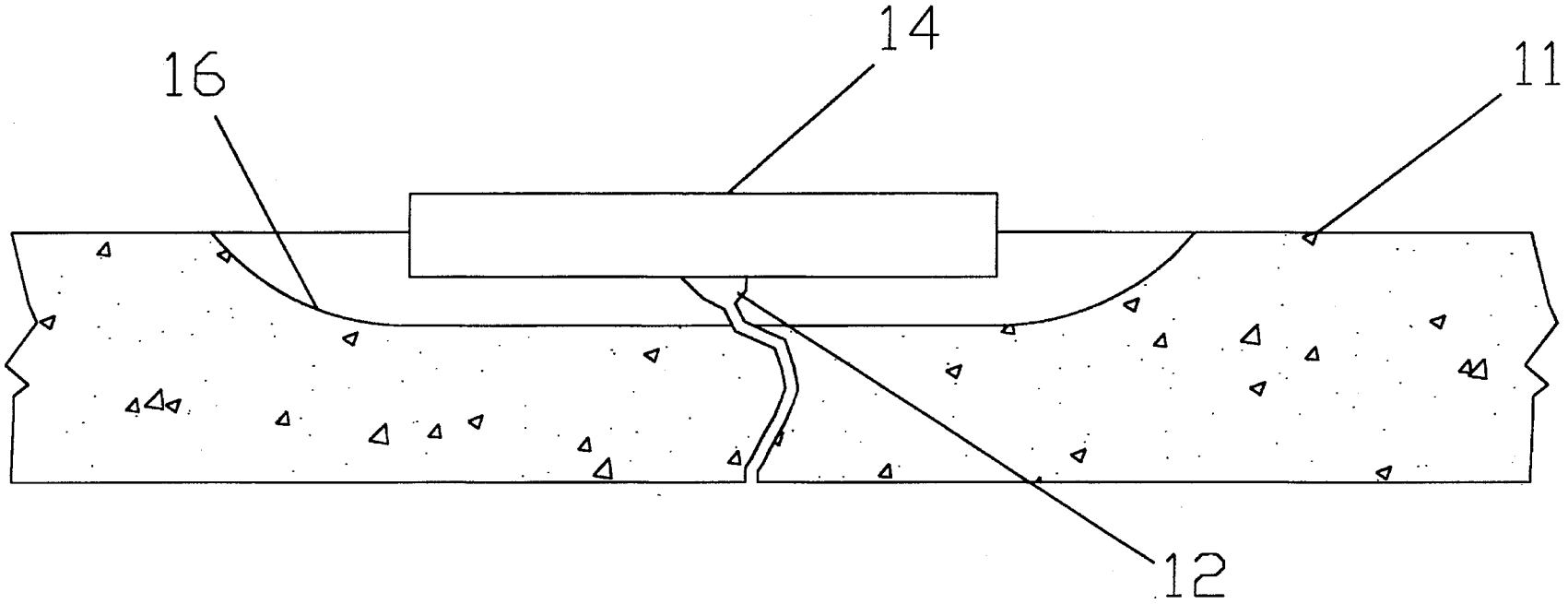
FIG. 6 is a side view of a large metal bracket being inserted into a saw cut.
Figure 7:
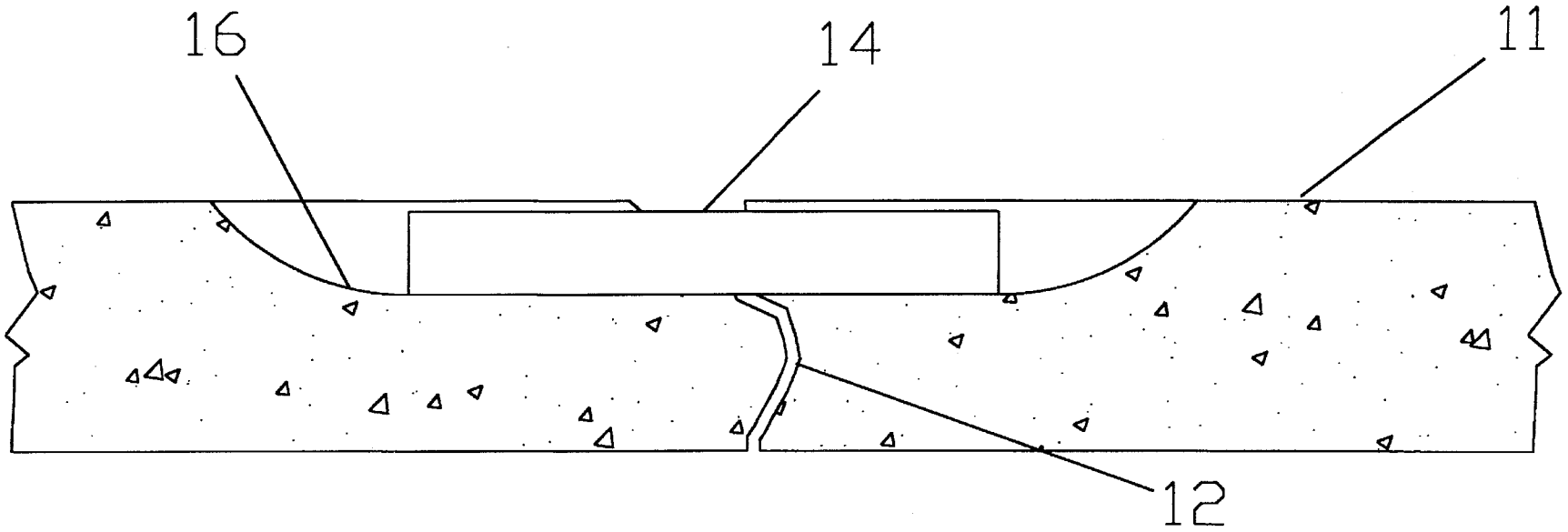
FIG. 7 is a side view of a large metal bracket seated in the saw cut in the concrete slab.
Figure 8:
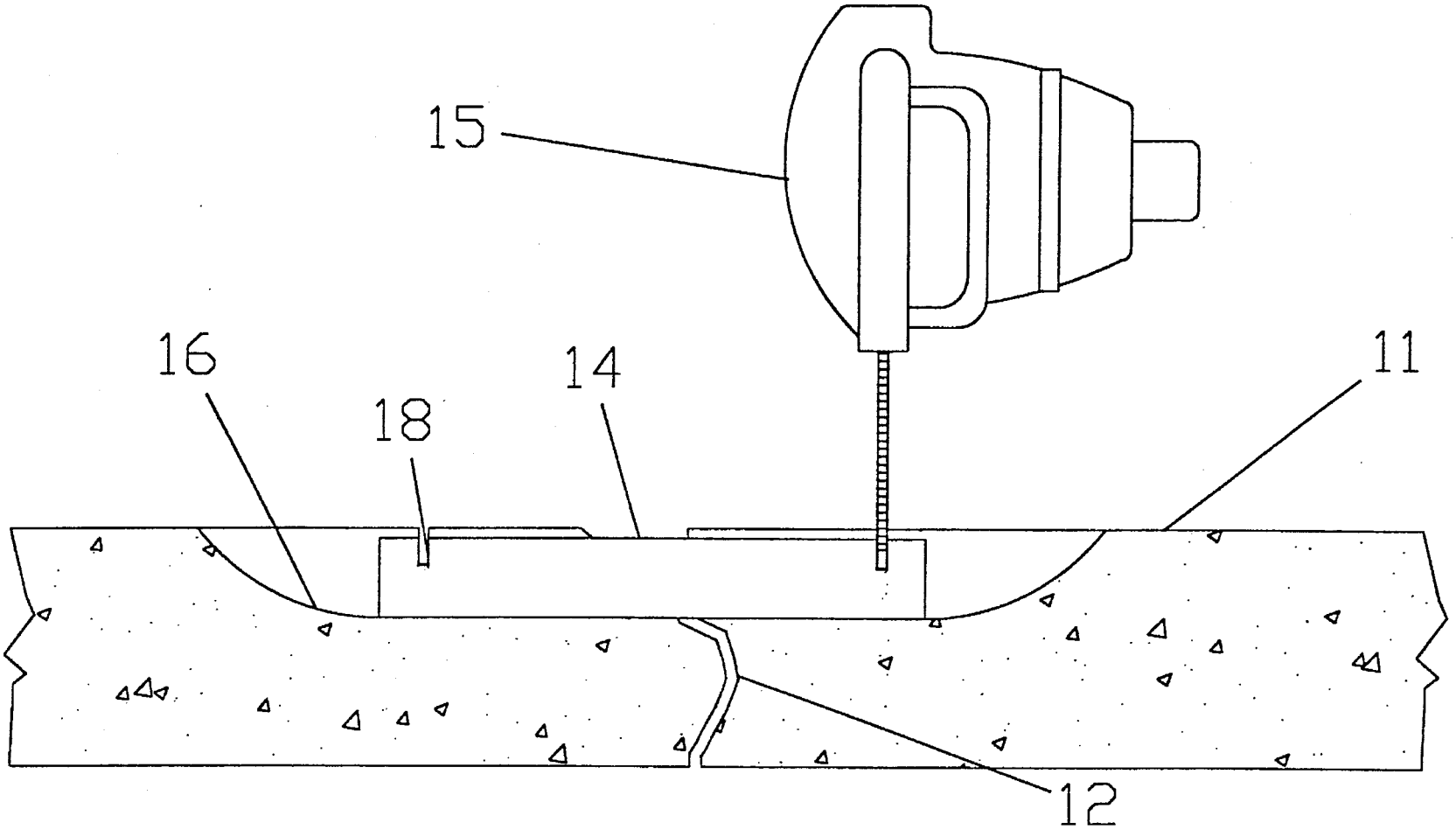
FIG. 8 is a side view of a a concrete saw making a cross cut in the concrete slab and the large metal bracket simultaneously.
Figure 9:
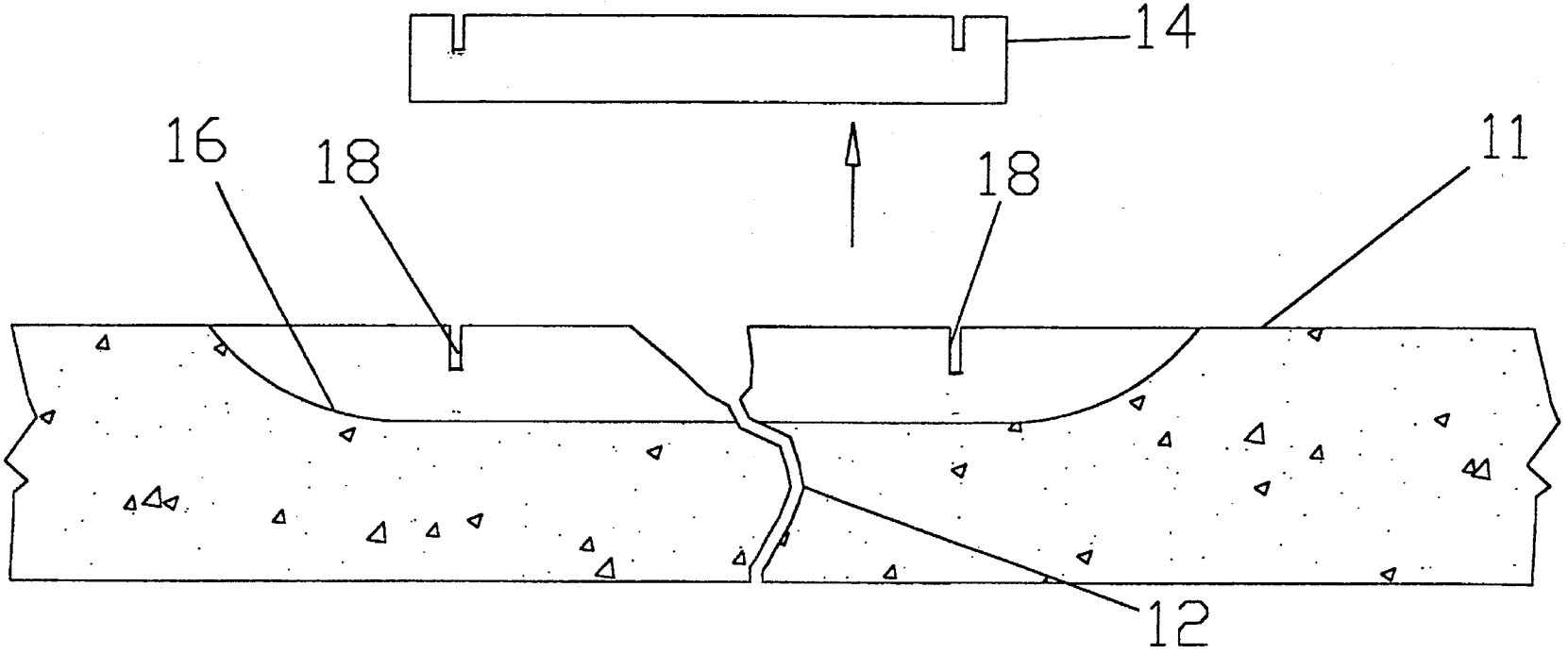
FIG. 9 is a side view of the large metal bracket and the concrete slab cut showing the the cross cuts.
Figure 10:
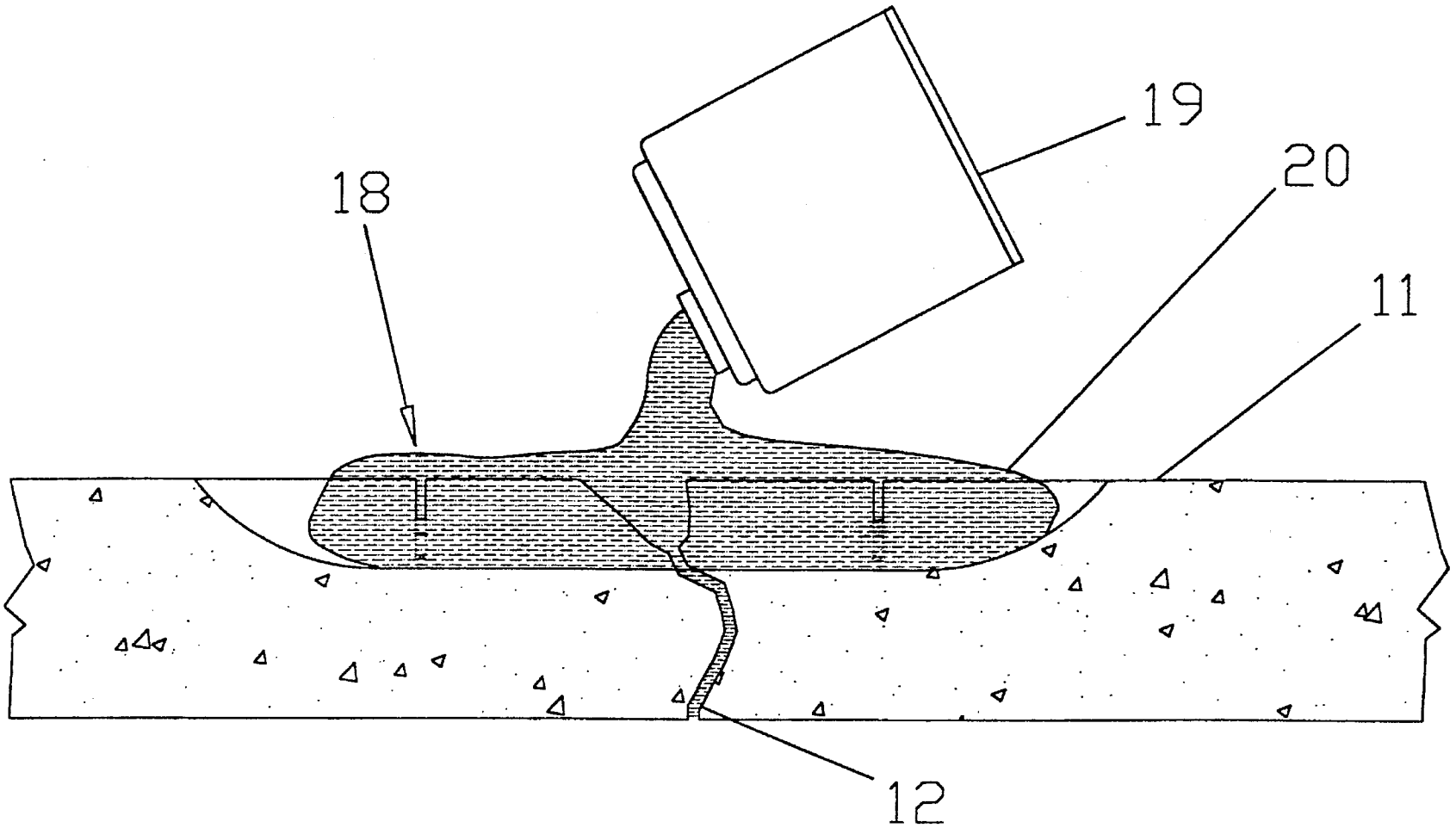
FIG. 10 is a side view showing the resin filler mix being poured into the saw cuts in the concrete section.
Figure 11:
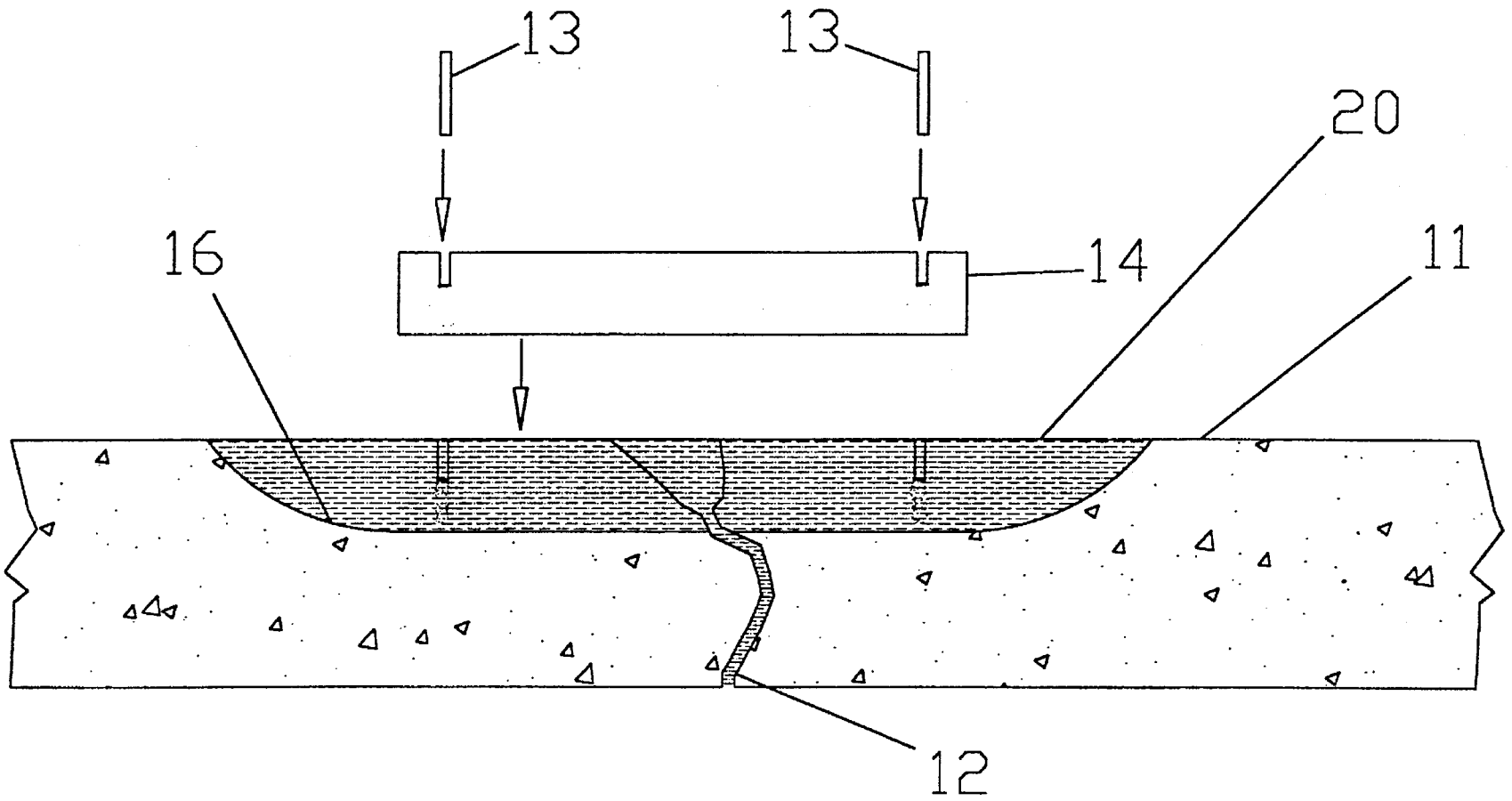
FIG. 11 is a side view showing the large metal bracket and the end bracket being installed into the resin mix filled cut in the concrete slab.
Figure 12:
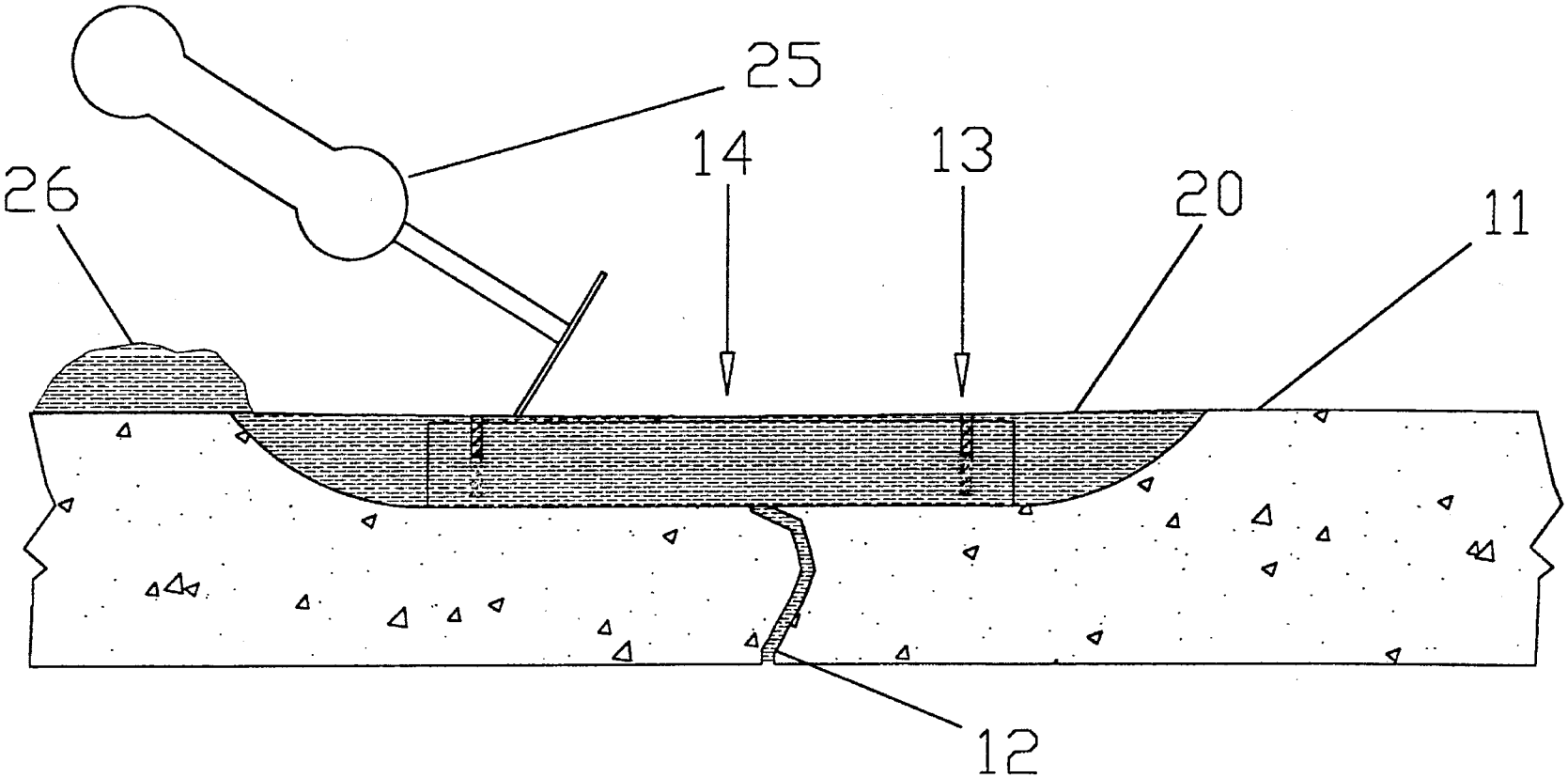
FIG. 12 is a side view showing the filler mix being squeegeed to provide a level surface.
Figure 13:
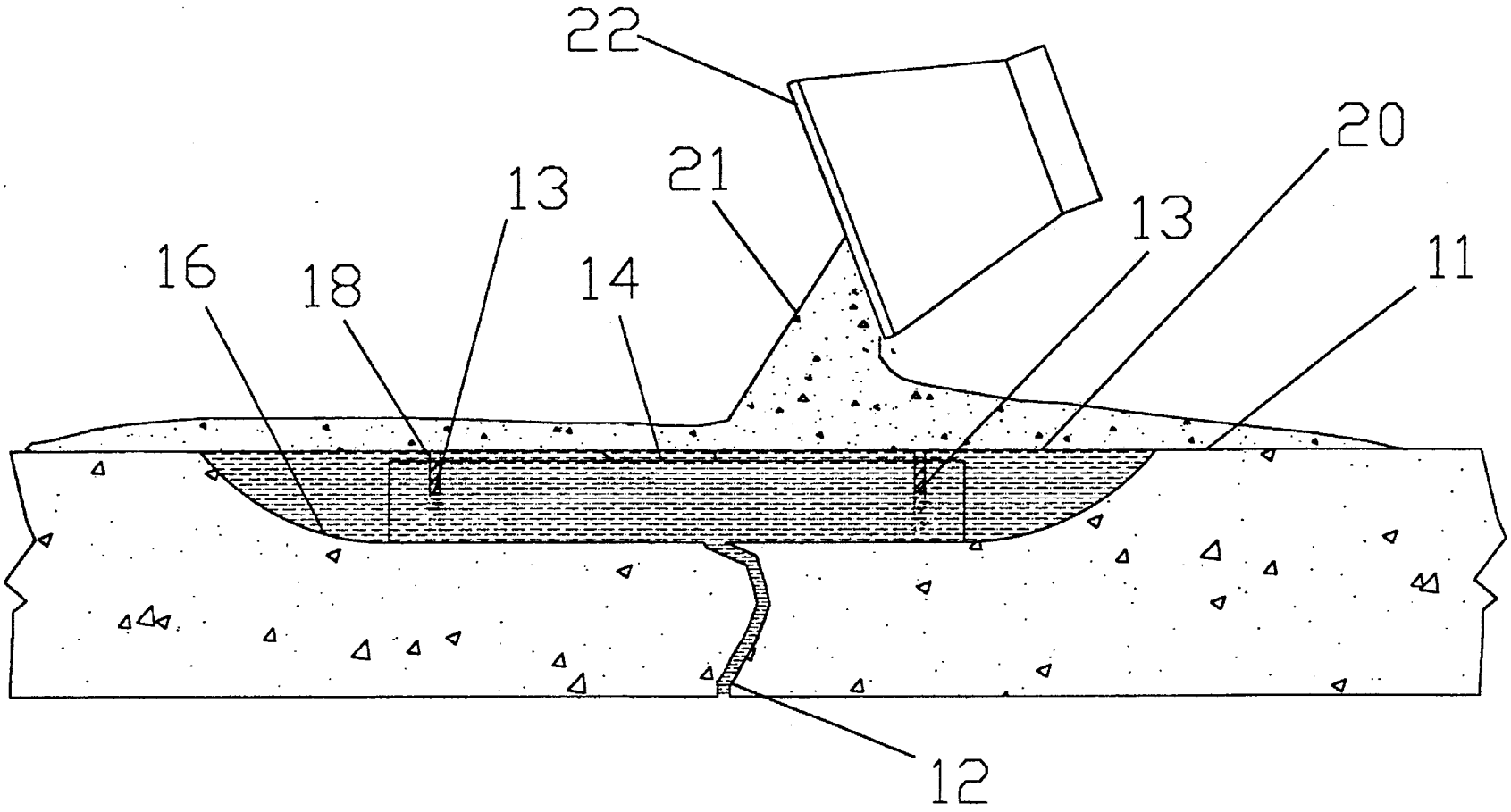
FIG. 13 is a side view showing the application of a second coating over the stitched area.
Figure 14:
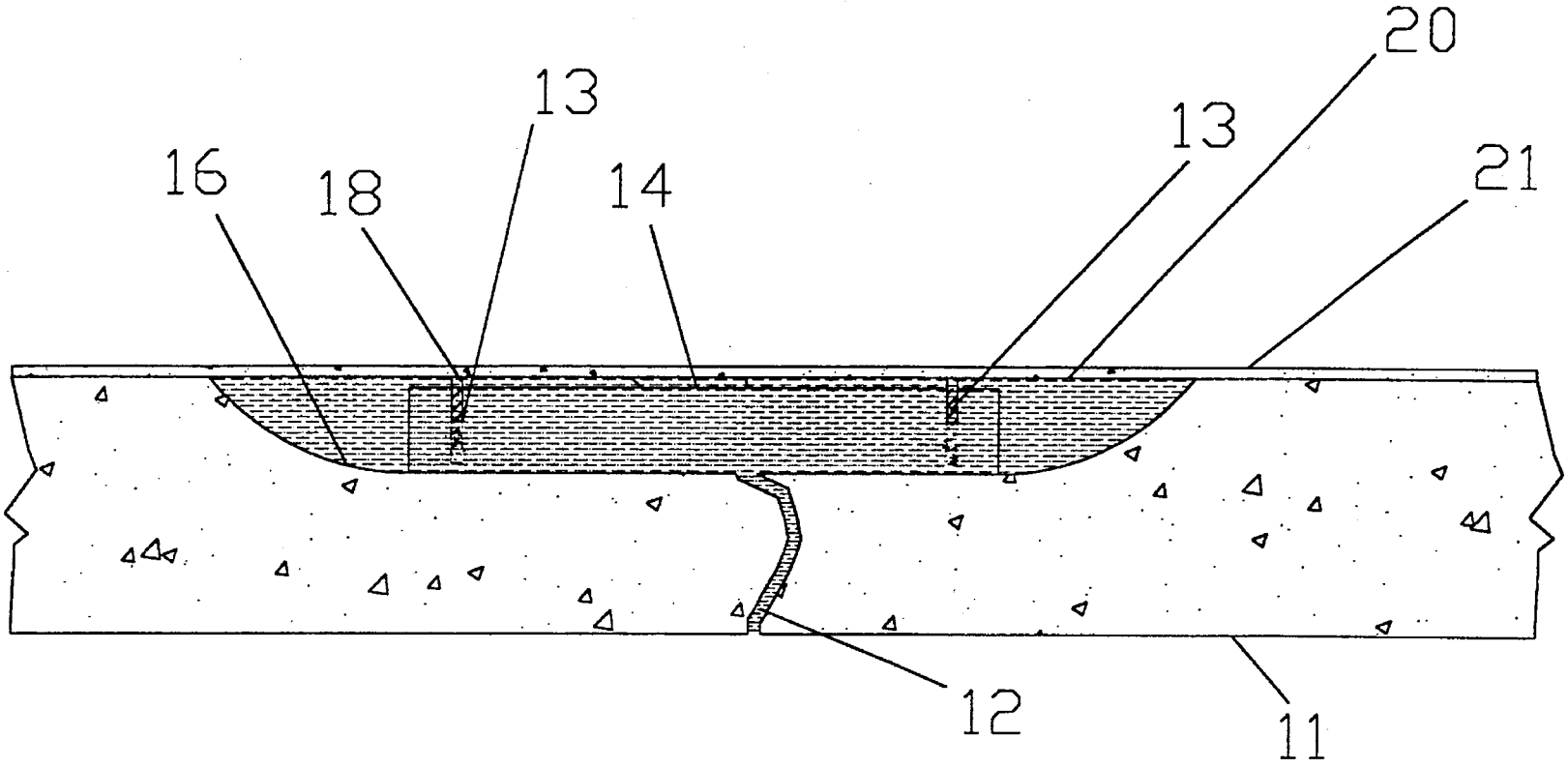
FIG. 14 is a side view showing a finished application of the second coating.
Figure 15:
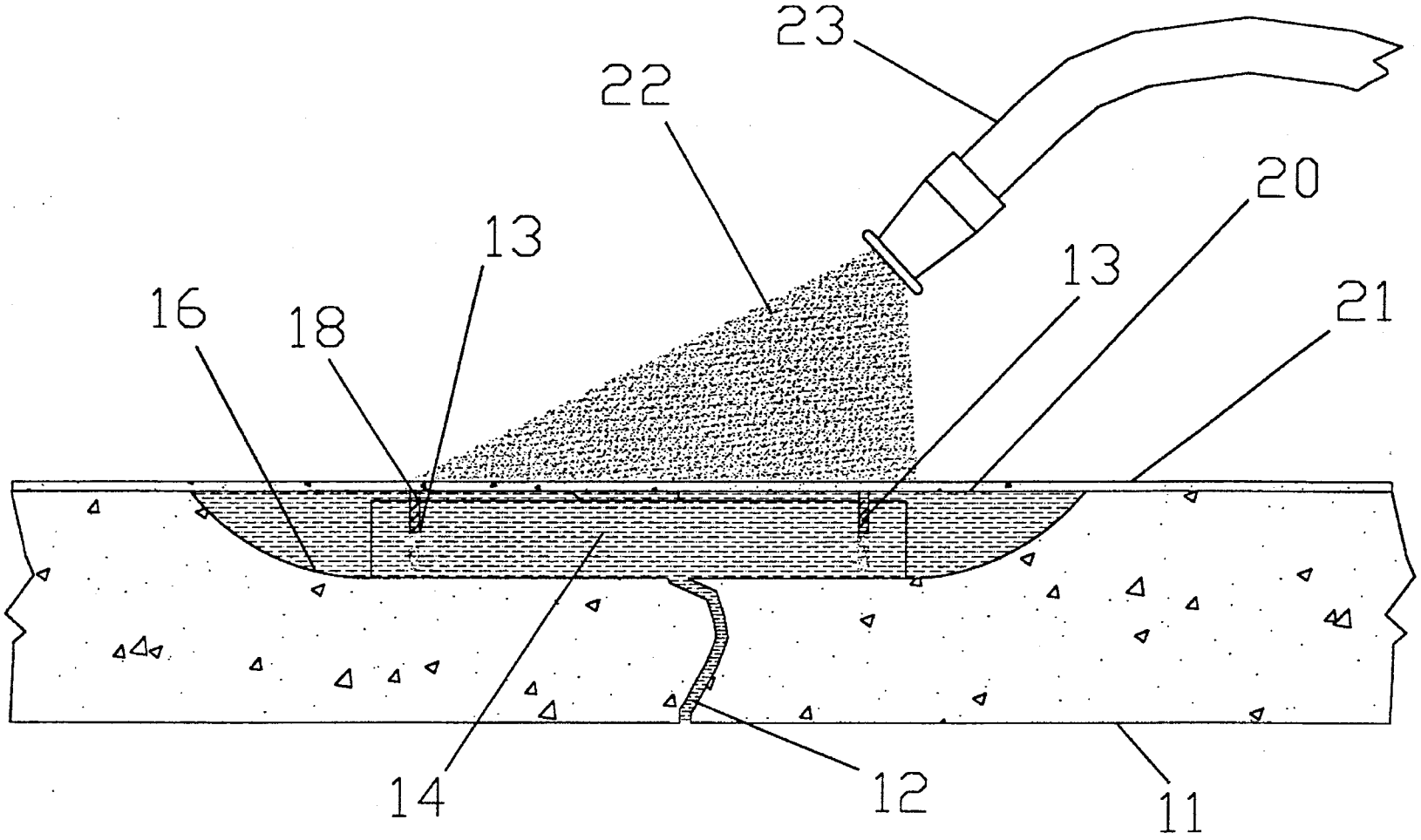
FIG. 15 is a side view of a spray application of a final coating.

FIG. 1 is a top view of a concrete section depicted by the numeral 10 and having a crack repaired by the concrete internal metal stitching system and method of the invention. Top surface 11 of concrete section 10 is shown with a crack 12 having the assembly of large metal brackets 14 and end brackets 13. FIG. 2 is a side sectional view showing a crack in the concrete section before repair by the method and system of the invention.

The first step of the process of the invention is to rout the crack 12 with a 12" or 14" concrete saw 15 with standard masonry blades or diamond blades available at most tool rental shops. It is important to remove all of the loose pieces of concrete from the crack to permit better bonding of a crack filler 20.

In a preferred embodiment, the metal stitch kit of the invention for repairing an average of 32 linear feet, comprised 16 large metal brackets 14 (8200 lbs. tensile strength), 32 small end brackets 13, 1 gallon of crack filler 20 with hardener (11,000 P.S.I. of compressive strength), 14 pounds of filler additive (calcium carbonate-crushed, powdered stone) and complete detailed instructions. After the crack 12 is prepared, it should then be measured and marked 1 foot from both ends of the crack divided in approximately 2 foot intervals.

Wearing safety glasses and dust mask, concrete saw cuts 16 are made at alternating, approximately 60° angles to crack 12 and other angles as permitted, on the previously made marks which are spaced approximately 2 feet apart from each other. The saw cuts may be made with a standard hand held concrete saw 15 to facilitate the insertion of the metal brackets, such as, end metal bracket 13 and large metal bracket 14, one quarter inch below the concrete slab top surface 11. In a preferred embodiment, the saw cut 16 was large enough to accommodate a large metal bracket 14, 14" long, 2½" high, ⅛" thick, with the top surface of the large bracket 14, ¼" below the top surface 11 of concrete section 10.

The large metal bracket 14 is then placed into and seated in the concrete saw cut 16, with the top surface ¼" below the concrete slab surface 11. With the large metal bracket 14 resting in the saw cut 16, the large bracket 14 is then measured and marked one inch from each end. A saw cut 18 is then made at the 1" mark, in the concrete and simultaneously through large metal bracket 14, perpendicular to the large metal bracket 14 or generally parallel to the concrete crack 12. The large bracket 14 and the concrete section 10 are cut to a sufficient depth that will permit the small end brackets 13 to be inserted again, ¼" below the concrete section top surface 11. In a preferred embodiment the end brackets 13 were made from metal, 1"×2"×⅛. The end brackets 13 are inserted to a depth of ¼" below surface 11 at approximately 90° to the large bracket 14. The end brackets 13 are used to precisely stabilize and lock movement of the large brackets 14.

Each of the bracket assemblies are then removed from the concrete slots and numbered to assure that each of the assemblies is returned to the original site. Each large bracket 14 and end bracket 13 should be returned to its respective slot from which it was removed. The saw cuts 16 and 18 are then cleaned, either with a vacuum or by blowing if the cut was made with a dry cut saw. If the cut was made with a wet cut, the cut should be acid etched and pressure cleaned. The slot should be allowed to dry and a propane torch may be used for drying.

The next step of the process is to mix the crack filler 20 which includes a polyester epoxy resin filler, a filler additive (calcium carbonate), and a catalyst in a container 19. Since the filler and catalyst 20 contain toxic materials, the operator should wear gloves in the preparation of the filler 20. The crack filler mix 20 is then poured into the clean, dry crack 12 as well as the clean, dry concrete saw cuts 16 and 18. After the crack 12 and saw cuts 16 and 18 are filled, the large brackets are inserted in saw cuts 16 and hammered down to be seated in the saw cuts 16 with the top surface ¼" below the top surface 11. End brackets 13 are then inserted in the appropriate saw cuts 18 and hammered down to be seated in the saw cuts 18 in the concrete section 10 and the large bracket 14 with the top surface ¼" below the top surface 11.

The filler 20 is then smoothed out with a squeegee or trowel 25 and the surplus 26 removed. Additional mixed filler 20 may be added if required to achieve concrete level. The excess resin filler 20 can easily be scraped flush to the surface while curing. When cured, grinding would be necessary and scraping would be ineffective. Once scraped or ground smooth, the repair is complete, although a polymer modified cement 21 may be mixed in container 22, spray applied and broom finished to achieve a natural look broom finished concrete surface. A final decorative surface 22 may be applied with spray hose 23 and finished with a pattern tool or skip troweled.

Figure 16:
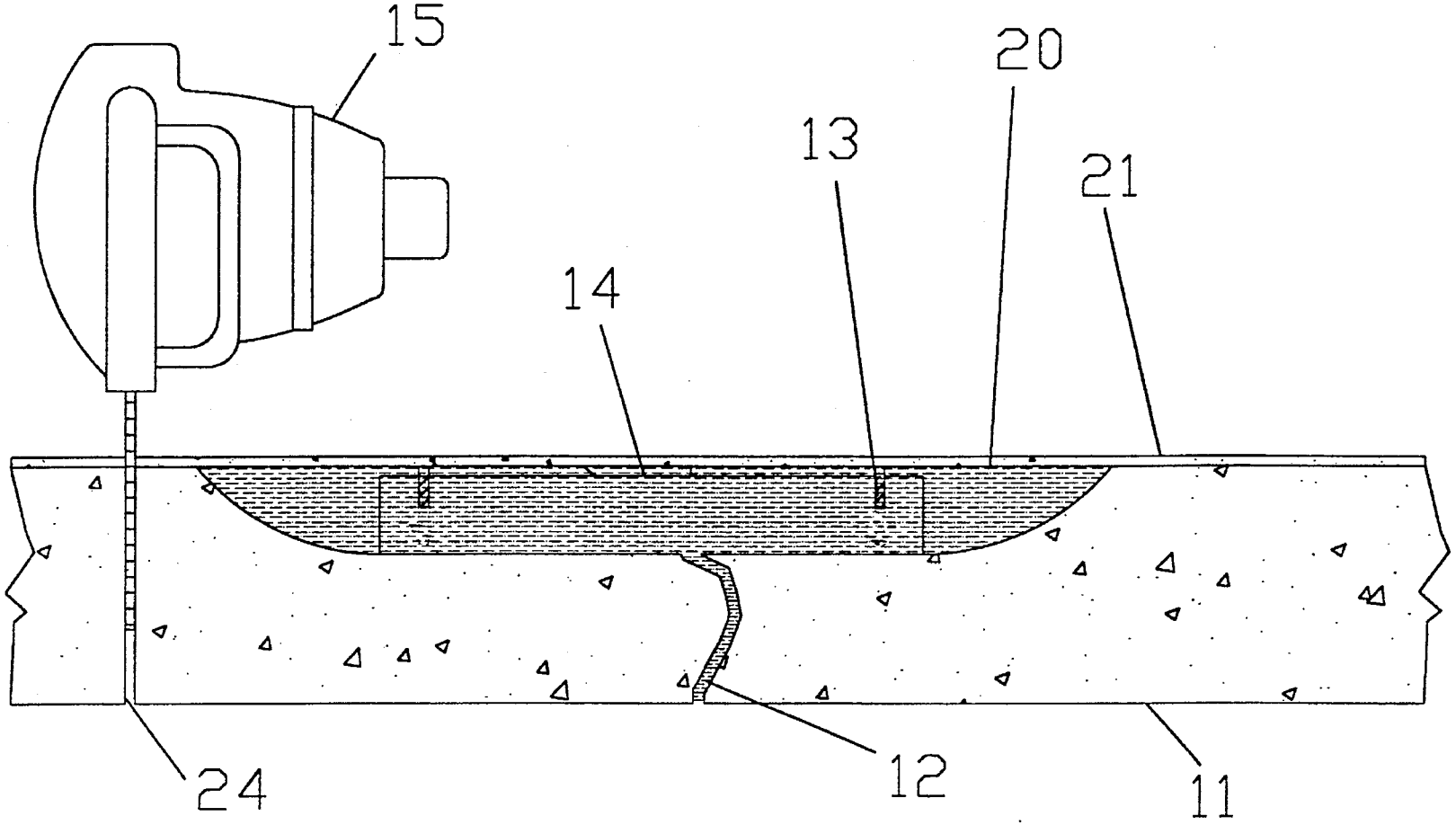
FIG. 16 is a side view of a new control cut in the concrete section.

Quite often, existing, shallow score cuts do not function to allow for expansion and contraction. If there is a score joint near the repair, it should be re-cut through the entire thickness of the slab to relieve all further stresses from the repair area. As shown in FIG. 16, if a score cut 24 is not present, it should be made within a short distance from the repair. A clear proof test of expansion and contraction is to place a snugly fitted nail in a crack when the concrete is cool (early in the morning) and it will lock up tight in the afternoon with the heat of the sun.

The process and system of the invention provide many features not available in the prior art. The invention is convenient and easy to install and provides a rugged, inexpensive solution to a common problem of concrete cracks. The invention kit comes with full instructions and video. It is a fast repair, 32 linear feet repaired in approximately 2 hours. Each kit adds in excess of 128,000 pounds of tensile strength per 32 linear feet of cracks. A new control cut 24 relieves stress from the repaired area if required. The kit is inexpensive, especially when compared to the cost of replacing the entire concrete area.

The present embodiments of the invention are thus to be considered in all respects as illustrative and not restrictive, the scope of the invention being indicated by the appended claims rather than by the foregoing description. All changes which come within the meaning and range of equivalency of the claims are intended to be embraced therein.

What is claimed is:

1. An internal metal stitching method for repairing cracks in concrete, the method comprising:

removing loose pieces of concrete from the crack for improving the surface for bonding, cutting a first series of saw cuts in the concrete at alternating angles to the crack, inserting a large metal bracket having a first and a second end in each of said first series of saw cuts, cutting a second series of saw cuts in the concrete and simultaneously near a first end of said large metal brackets, cutting a third series of saw cuts in the concrete and simultaneously near a second end of said large metal brackets, inserting an end bracket in each of said second and third series of saw cuts, said first, second and third saw cuts being sufficiently deep to retain said large and end brackets at least one quarter inch below the surface of the concrete when inserted, removing said large and end metal brackets from said saw cuts, and marking each bracket for return to its original site, cleaning and drying the concrete crack and all of said saw cuts, mixing a resin filler, a filler additive, and a hardener in a container, pouring said filler into and filling said saw cuts and the crack, replacing said large metal brackets in each of their original saw cuts, and seating said large metal brackets below the surface of the concrete, replacing said end brackets in each of their original saw cuts, engaging said saw cuts in said large metal brackets and seating said end brackets below the surface of the concrete, and, smoothing out said filler to a level flush with the concrete surface and removing excess filler by scraping or grinding.

2. An internal metal stitching method of claim 1 including the step of applying a coating of a polymer modified cement and brushing said coating to achieve a broom finish.

3. An internal metal stitching method of claim 2 including the step of spraying on a decorative surface.

* * * * *